US005820262A

United States Patent [19]

Lechner

[11] Patent Number: 5,820,262

[45] Date of Patent: Oct. 13, 1998

[54] SMART REFRIGERANT SENSOR

[75] Inventor: Thomas J. Lechner, Mequon, Wis.

[73] Assignee: Johnson Service Company, Milwaukee, Wis.

[21] Appl. No.: 760,980

[22] Filed: Dec. 5, 1996

[51] Int. Cl.[6] ..... G01N 25/00; G01K 1/14; G01K 13/02

[52] U.S. Cl. ..... 374/45; 374/143; 374/141; 374/147; 62/212

[58] Field of Search ..... 374/45, 143, 147, 374/148, 141; 62/212, 129

[56] References Cited

U.S. PATENT DOCUMENTS

| | | | |
|---|---|---|---|
| 4,328,948 | 5/1982 | Pearl, II | 251/149.6 |
| 4,545,212 | 10/1985 | Noda | 62/212 |
| 4,617,804 | 10/1986 | Fukushima et al. | 62/212 |
| 4,768,348 | 9/1988 | Noguchi | 62/212 |
| 5,070,706 | 12/1991 | Waters et al. | 374/143 |
| 5,450,875 | 9/1995 | Chichester et al. | 251/149.6 |
| 5,586,445 | 12/1996 | Bessler | 62/129 |
| 5,666,815 | 9/1997 | Aloise | 62/129 |

FOREIGN PATENT DOCUMENTS

| | | | |
|---|---|---|---|
| 0183767 | 7/1990 | Japan | 62/212 |
| 405223358 | 8/1993 | Japan | 62/212 |

OTHER PUBLICATIONS

Alco Controls (division of Emerson Electric), "*Operating Principle and Application of Thermostatic Expansion Valve*", 1987, pp. 1–6. (no month).

S.A. Tassou and H. Al–Nizari, *Heat Recovery Systems & CHP —"Investigation of the Steady State and Transient Performance of a Reciprocating Chiller Equipped with an Electronic Expansion Valve*", 1991, vol. 11, No. 6, pp. 541–550. no month.

P.M.T. Broersen & M.F.G. van der Jagt, "*Hunting of Evaporators Controlled by a Thermostatic Expansion Valve*", Jun. 1980, vol. 102, pp. 130–135.

*Primary Examiner*—Diego F.F. Gutierrez
*Attorney, Agent, or Firm*—Quarles & Brady

[57] ABSTRACT

A Refrigerant Sensor is provided that provides within a common assembly pressure, temperature and superheat measurements and calculations with respect to a refrigerant material. The Refrigerant Sensor includes a pressure transducer for measuring the pressure of the refrigerant material and a temperature transducer for measuring the temperature of the refrigerant material. The pressure and temperature measurements are used by a microprocessor to calculate the superheat value of the refrigerant material. The microprocessor is within the common assembly. The Refrigerant Sensor can send and receive information from the network and also calibrate the pressure and temperature measurements.

8 Claims, 3 Drawing Sheets

FIG. 2
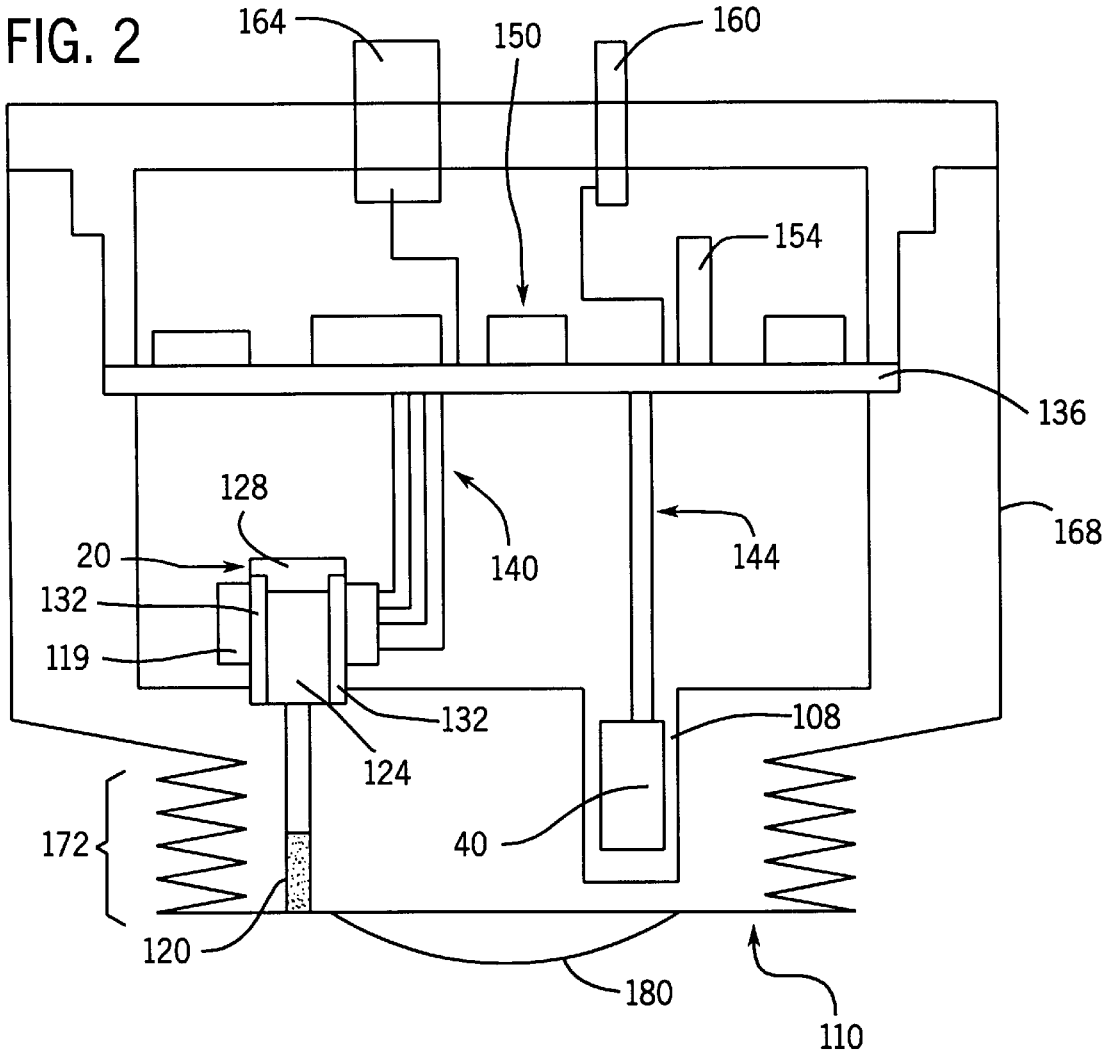
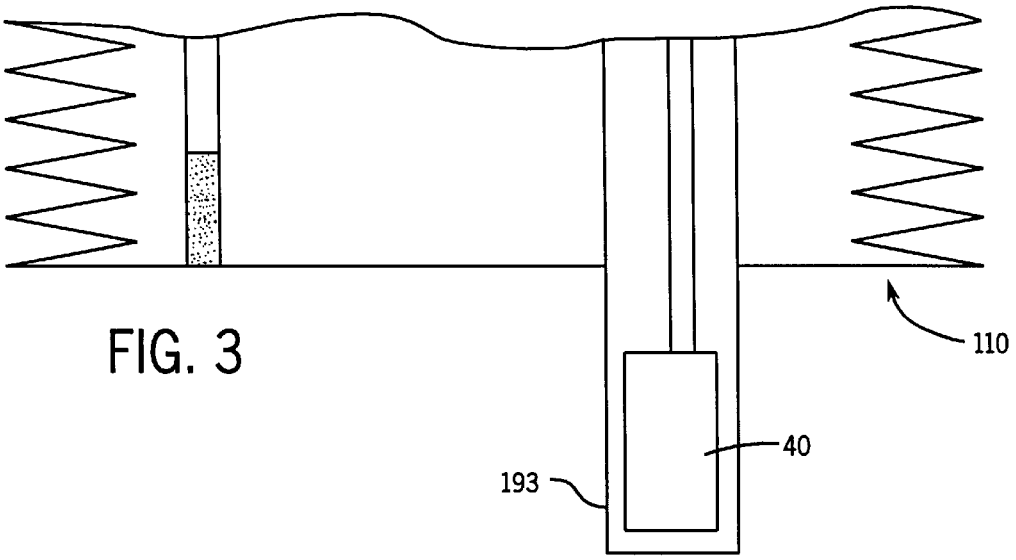
FIG. 3

SMART REFRIGERANT SENSOR

BACKGROUND OF THE INVENTION

1. Field of the Invention

The present invention relates generally to refrigeration control systems and more particularly to refrigeration sensing devices.

2. Description

Previous refrigerant sensors have been used to measure certain properties of the refrigerant in order to better control the overall refrigeration cycle. Since pressure and temperature are interrelated for a particular refrigerant, previous refrigerant sensors have used one of those properties in order to determine the other at various points in the refrigeration cycle. However, there is a point at which they are no longer interrelated—for example, if more heat is added to the refrigerant, it becomes superheated, and pressure and temperature are no longer interrelated. When the refrigerant reaches that certain superheated point, the temperature rises even though the pressure does not.

Within the refrigeration cycle, a liquid is placed at the input of the evaporator and evaporates as it passes through the evaporator. As it starts to evaporate (i.e., heat is removed from it), the refrigerant becomes gaseous. It is desirable for the refrigerant to become fully gaseous at the outlet of the evaporator since the compressor lies at the outlet of the evaporator. If liquid were to enter into the compressor, it would retard the operation of the compressor.

Accordingly, the ideal evaporator would have liquid refrigerant going into the evaporator with the refrigerant being evaporated all throughout the arm of the evaporator. At the exit of the evaporator, the refrigerant would be fully gaseous and the superheat value of the refrigerant would be essentially zero. A superheat value of zero is ideal since it implies that the refrigerant has been fully evaporated as well as optimizing the amount of resources needed to evaporate the refrigerant. If the superheat value of the refrigerant at the exit of the evaporator is above zero then that implies that the refrigerant had been converted into gas somewhere before exiting the evaporator. Thus, control of the evaporator at substantially zero superheat at the exist of the evaporator would be an ideal situation for a refrigeration cycle.

Previous control mechanisms used temperature measurements to determine the superheat value. They measured the temperature of the vapor and liquid combination at the inlet and measured the temperature of the refrigerant at the outlet of the evaporator. They then tried to minimize the superheat to ensure that all of the liquid had been evaporated. In other words, they exceed the point of the superheat value being zero by 10–20 degrees of superheat to ensure that all of the liquid refrigerant has evaporated. However, the more degrees of superheat that exists at the exit of the evaporator, the less efficient the evaporator becomes.

Early refrigeration control systems typically used mechanical controls to minimize the superheat at the outlet of an evaporator system. These controls sensed the entering and leaving temperatures with a liquid expansion system, which operated the refrigerant valve directly. They were simple, low cost, and reliable, but, they were limited in their ability to reduce the superheat at the exit of the evaporator. Their inability to be more effective is inherent, because they used proportional control techniques, and therefore were bounded by instability as the gain is increased to reduce the offset (superheat error).

Next generation systems use electronic techniques with electrically operated expansion valves to control superheat.

In this case, two temperature sensors were commonly employed with a microprocessor to control a stepper motor (or other electrically operated) expansion valve. These systems gave better control, reducing superheat to the 5–10 degree range. Complicated algorithms are employed to provide the necessary stability that mechanical systems could not overcome. Temperature sensing at the output however adds a time lag that complicates the issue and still limits the error reduction. Pressure transducers were then tried, as pressure is more dynamic than temperature, but these transducers needed to have great accuracy at the point where temperature and pressure diverge ( refrigerant boiling point). This problem is most critical in low temperature applications, because pressure transducer error is a % of full scale, thus, the error is greater at the low end of the range. As a result, none of these systems have reached consistent, stable control, at low superheat setpoints (2–4 degrees).

SUMMARY OF THE INVENTION

Accordingly, the present invention is a refrigerant sensor for measuring properties of refrigerant material in a refrigeration cycle. The refrigerant sensor includes a pressure transducer for measuring the pressure of the refrigerant material. It includes a temperature transducer for measuring the temperature of the refrigerant material, as well as a thermal property calculator. The thermal property calculator calculates a thermal property of the refrigerant material based on the measured pressure and measured temperature. The pressure transducer, temperature transducer, and thermal property calculator are all housed within a common assembly. The thermal property calculator includes a superheat calculator for calculating the superheat characteristic of the refrigerant material based upon the measured pressure and temperature.

Additional advantages and features of the present invention will become apparent from the subsequent description and the appended claims, taken in conjunction with the accompanying drawings.

BRIEF DESCRIPTION OF THE DRAWINGS

Additional advantages and features of the present invention will become apparent from the subsequent description and the appended claims, taken in conjunction with the accompanying drawings, in which:

FIG. 2 is a cross-sectional view of the refrigerant sensor with the pressure transducer being for this embodiment a ceramic cylinder containing a bridge device;

FIG. 3 is a cross-sectional view of a portion of the refrigerant sensor with the temperature transducer (sensor) projecting from the common assembly.

DESCRIPTION OF THE PREFERRED EMBODIMENTS

Figure 1:
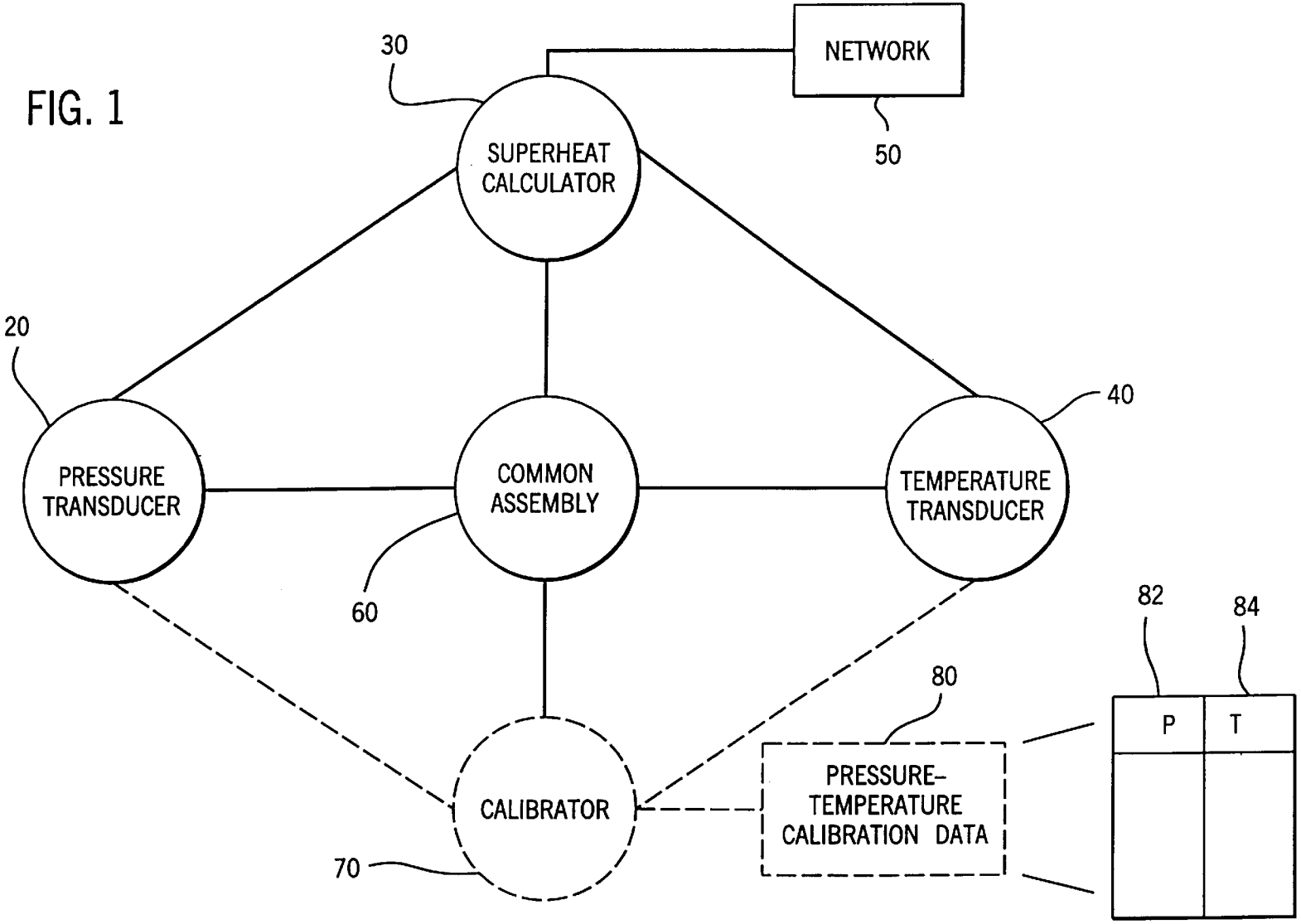
FIG. 1 is an entity relationship diagram which depicts the relationships among the components of the refrigerant sensor.

FIG. 1 is an entity relationship diagram in which the various components of the refrigerant sensor and their relationships are shown. The refrigerant sensor has a pressure transducer 20 which measures the pressure of the refrigerant and sends that measured pressure value to the superheat calculator 30. A temperature transducer 40 measures the temperature of the refrigerant and sends the measured temperature value to the superheat calculator 30.

The superheat calculator 30 calculates the superheat of the refrigerant based upon the measured pressure and temperature values for that refrigerant, and sends the superheat, pressure, and temperature values to a control network 50. The superheat calculator 30, pressure transducer 20, and the temperature transducer 40 are all contained within a common assembly 60. Accordingly, within this one common assembly, the pressure, temperature, and superheat values for the refrigerant are produced.

Moreover, the refrigerant sensor may contain capability for self-calibration. The calibrator 70 calibrates the measurements of the pressure transducer 20 and temperature transducer 40 based upon data contained within the pressure-temperature calibration data table 80. Within the pressure-temperature calibration data table 80, are pressure and temperature values which serve as checks for the measured values done by the pressure transducer 20 and the temperature transducer 40. The pressure-temperature calibration data table 80 contains a column of pressure values 82 cross-correlated with a column of temperature values 84 for performing the aforementioned calibration. The preferred embodiment allows for the downloading of temperature and pressure information for one or more refrigerants into the pressure-temperature calibration data table 80. The downloaded information may come from the network 50.

More specifically for the calibration, the refrigerant sensor of the present invention provides optimal calibration since it incorporates within the sensor, the pressure and temperature transducer into one embodiment so that the device itself can be calibrated at the superheat value rather than have a pressure transducer and a temperature transducer (both of which have errors) report their respective measurements back to a remotely located microprocessor which would then try to calibrate those two measurements.

Within the refrigerant sensor of the present invention is a microprocessor that contains pressure-temperature relationships for the particular refrigerant of the refrigeration cycle. For example, the refrigerant sensor could calibrate itself whenever the refrigerant goes into a superheat condition. The refrigerant sensor when in this mode would be able to determine what the correct temperature of the refrigerant should be when the pressure is a particular value so that if any discrepancy between the measured values versus the calibrated values does arise, the refrigerant sensor would be able to detect this and view it as a reading error. When such an error has been detected, the refrigerant sensor could zero out the discrepancy.

For the preferred embodiment, the refrigerant sensor could offset one of the two measured readings so that they would coincide to what the calibrated data is. For example, if the refrigerant sensor reads a pressure of 250 p.s.i. and a temperature measurement of 54 degrees Fahrenheit, and the calibration data indicates that at a pressure of 250 p.s.i. the temperature measurement should only be 52 degrees Fahrenheit, then the refrigerant sensor knows that there is a two degree error at that particular reading. The refrigerant sensor then can continually determine the expected value and the actual value when it is in the known non-superheat condition and accordingly cancel out any error.

The output of the refrigerant sensor to the network 50 may include an analog output which would include one output each for pressure, temperature, and superheat. The output could also be an analog output in which there would be one output that alternately displays the pressure, temperature, and superheat value in sequence, along with a pair of outputs that provide the multiplexed reference, e.g., 01 (binary) pressure, 10 (binary) temperature, and 11 (binary) superheat. Another output could be a digital output which would be dependent on the multiplexed input. However, the preferred embodiment has the refrigerant sensor containing a microprocessor that reports the pressure, temperature, and superheat values to a communication port (e.g., an RS485 or Echelon Port). The refrigerant sensor could obtain its power from the communication line.

FIG. 2 shows a cross-sectional view of the refrigerant sensor of the present invention. A pulsation plug 110 on the bottom of the refrigerant sensor is made up of sintered material in the preferred embodiment so that it will have very fine pores in it to allow the refrigerant to permeate it very slowly. The pulsation plug 110 filters out the ripples resulting from the refrigerant being pumped by the compressor.

For the preferred embodiment, the pressure transducer 20 is a ceramic ring with bridge 119, which is screened on to the ceramic ring. It could also be a capacitive ring or any other of several known technologies. The pressure transducer 20 has sintered material at location 120 to also allow refrigerant to slowly enter into the pressure transducer. The pressure transducer 20 contains a chamber 124 and a cap 128 which seals off the chamber 124. As the pressure in the chamber 124 increases due to refrigerant flowing into the pressure transducer, the cylinder walls 132 are pushed out. The bridge 119 tracts the movement of the cylinder walls 132 and produces a resistance change relative to the change in refrigerant pressure. It then sends the pressure measurement to the circuit board 136 through the wires indicated at location 140.

The temperature transducer 40 senses the temperature of the refrigerant which is in cavity 108. The temperature transducer 40 then sends the temperature measurement to the circuit board 136 through the wires located at location 144. For the preferred embodiment, the temperature transducer 40 is a positive temperature coefficient, or negative temperature coefficient thermistor typical of multiple manufacturers such as Fenwal, Keystone, Yellowsprings, and Ketema Rodan.

The circuit board 136 holds the electronics of the refrigerant sensor which includes the superheat calculator 30. In the preferred embodiment, microprocessor 150 contains the superheat calculator 30. The microprocessor 150 receives the measured values from the pressure transducer 20 and the temperature transducer 40 after the measurements have been passed through an A/D converter 154. The microprocessor 150 takes the measured pressure and measured temperature readings and uses conventional refrigeration superheat calculations to calculate the superheat value of the refrigerant.

This feature of providing both the pressure and temperature in one embodiment allows the calibration of the device to be essentially zero error at the boiling point (critical pressure and temperature) of the refrigerant, which is useful for a zero superheat control.

The pressure, temperature, and superheat values can be forwarded to the network 50 through the network connector 160. Power is supplied to the refrigerant sensor at the power connector 164. It should be understood that this type of connector arrangement may vary depending upon the implementation. This particular embodiment serves only to illustrate one possible embodiment of the present invention.

The components of the refrigerant sensor are contained within the refrigerant sensor body 168. In the preferred embodiment, the refrigerant sensor body 168 has threads 172 at its bottom so that the refrigerant sensor can be directly screwed into the wall of the refrigeration cycle equipment (e.g., at the outlet of the evaporator). The size of the refrigerant sensor is essentially the same size as a pressure sensor, in that the temperature sensor is essentially insignificant in size. Moreover, a schrader depressor 180 depresses a schrader depressor valve which is in the refrigeration cycle equipment so that the schrader depressor valve becomes more fully disengaged as the refrigerant sensor is unscrewed. This prevents the refrigerant from leaking while the refrigerant sensor is either being screwed or unscrewed from the refrigeration cycle equipment.

FIG. 3 is an alternate embodiment of the embodiment shown within FIG. 2. FIG. 3 shows the temperature transducer 40 with an extension 193 which projects the temperature transducer 40 further from the pulsation plug 110 than in the embodiment shown in FIG. 2. The extension 193 of FIG. 3 for the temperature transducer 40 allows the temperature transducer to be in better contact with the refrigerant fluid and also to be further from the "warm" electronic components on the circuit board 136 whose additional heat may provide error to the temperature readings of the temperature transducer 40. For the preferred embodiment, an extension of greater than 0.25 inches is preferred.

Figure 4:
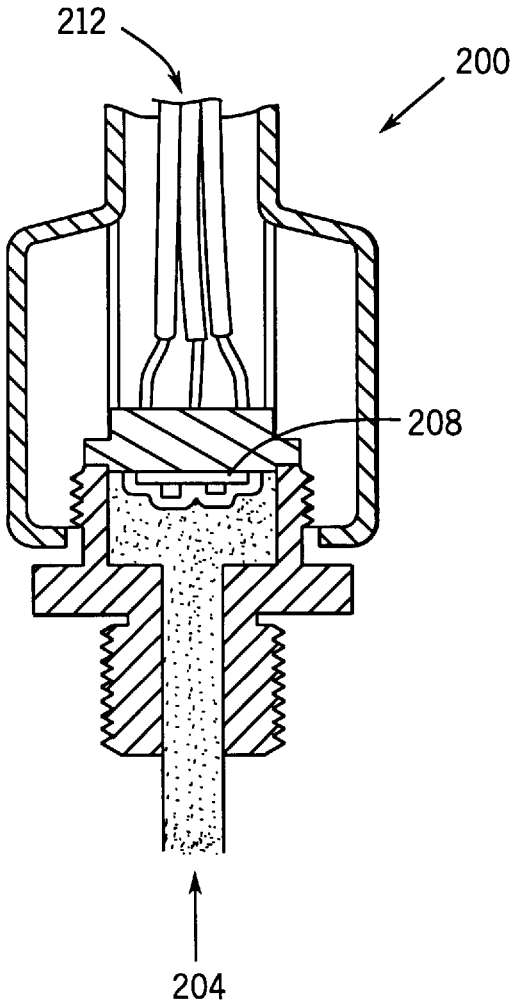
FIG. 4 is a cross-sectional of a pressure transducer being a pressure disk containing a bridge device.

FIG. 4 shows a pressure disk 200 being used as a pressure transducer. This type of pressure transducer is commonly found throughout the refrigeration industry and can be obtained from such companies as Texas Instruments, Statham, or Kaulico. The inlet pressure from the refrigerant enters into opening 204 and is measured at the transducer 208. The wires at location 212 can connect to the circuit board in a manner similar to the connection of the wires at location 140 to the circuit board 136 in FIG. 2.

The cost for the refrigerant sensor of the present invention is approximately fifteen dollars. Accordingly, the present invention can achieve the same cost of the previous electronic sensing devices while providing markedly the improved accuracy and evaporator performance.

The embodiment which has been set forth above was for the purpose of illustration and was not intended to limit the invention. It will be appreciated by those skilled in the art that various changes and modifications may be made to the embodiment described in this specification without departing from the spirit and scope of the invention as defined by the appended claims.

It is claimed:

1. A refrigerant sensor for measuring properties of refrigerant material in a refrigeration cycle, comprising:

a pressure transducer for measuring pressure of said refrigerant material;

a temperature transducer for measuring temperature of said refrigerant material;

a calibrator coupled to the common assembly for calibrating said pressure transducer and said temperature transducer by comparing said measured pressure and said measured temperature with calibration data from a pressure-temperature data table;

a thermal property calculator for calculating a thermal property of said refrigerant material based on said measured pressure and said measured temperature; and a common assembly for housing said pressure transducer and said temperature transducer and said thermal property calculator.

2. The refrigerant sensor of claim 1 wherein said thermal property calculator is superheat calculator for calculating superheat characteristic of said refrigerant.

3. The refrigerant sensor of claim 2 wherein said pressure transducer is a ceramic ring with a bridge.

4. The refrigerant sensor of claim 2 wherein said pressure transducer is a pressure disc.

5. The refrigerant sensor of claim 2 wherein said common assembly includes a projection for projecting said temperature transducer outwardly into said refrigerant material.

6. The refrigerant sensor of claim 2 further comprising a pulsation plug connected to the common assembly for filtering pressure ripples from said refrigerant material coursing through said refrigeration cycle.

7. The refrigerant sensor of claim 2 wherein said superheat calculator has a communication port for connection to a building environmental control network, and said superheat calculator outputs said calculated superheat and said measured pressure and said measured temperature via the communication port onto said network.

8. In combination, a refrigeration system having a valve and a refrigerant sensor for measuring properties of refrigerant material in a refrigeration cycle of said refrigeration system, comprising:

a pressure transducer for measuring pressure of said refrigerant material;

a temperature transducer for measuring temperature of said refrigerant material;

a calibrator coupled to the common assembly for calibrating said pressure transducer and said temperature transducer by comparing said measured pressure and said measured temperature with calibration data from a pressure-temperature data table;

a thermal property calculator for calculating a thermal property of said refrigerant material based on said measured pressure and said measured temperature; and a common assembly for housing said pressure transducer and said temperature transducer and said thermal property calculator, and wherein said common assembly includes a depressor for depressing said valve for substantially preventing leakage of the refrigerant upon placement of said common assembly into said refrigeration system.

* * * * *